United States Patent [19]

Chow et al.

[11] Patent Number: 4,872,019

[45] Date of Patent: Oct. 3, 1989

[54] RADOME-LENS EHF ANTENNA DEVELOPMENT

[75] Inventors: Yung L. Chow, Waterloo; Sujeet K. Chaudhuri, Heidelberg, both of Canada

[73] Assignee: Her Majesty The Queen in right of Canada as represented by the Minister of National Defence, Ottawa, Canada

[21] Appl. No.: 129,626

[22] Filed: Dec. 7, 1987

[30] Foreign Application Priority Data

Dec. 9, 1986 [CA] Canada ..... 524264

[51] Int. Cl.[4] ..... H01Q 15/08; H01Q 1/42

[52] U.S. Cl. ..... 343/753; 343/872; 343/910; 343/911 R

[58] Field of Search ..... 343/753, 872, 909, 910, 343/911 R

[56] References Cited

U.S. PATENT DOCUMENTS

| | | | |
|---|---|---|---|
| 3,430,245 | 2/1969 | Wolcott | 343/872 |
| 3,787,872 | 1/1974 | Kauffman | 343/911 R |
| 3,886,561 | 5/1975 | Beyer | 343/911 R |
| 4,156,878 | 5/1979 | Dion | 343/909 |
| 4,220,957 | 9/1980 | Britt | 343/872 |
| 4,321,604 | 3/1982 | Ajioka | 343/909 |
| 4,769,646 | 9/1988 | Raber et al. | 343/911 R |

FOREIGN PATENT DOCUMENTS

| | | | |
|---|---|---|---|
| 0189803 | 8/1987 | Japan . | |
| 2096869 | 10/1982 | United Kingdom | 343/753 |

OTHER PUBLICATIONS

Dielectric Bifocal Lenses, Brown R., Institute of Radio Engineers Convention, vol. 4, Pt 1-5, 1956.

*Primary Examiner*—Rolf Hille
*Assistant Examiner*—Doris J. Johnson
*Attorney, Agent, or Firm*—William R. Hinds

[57] ABSTRACT

A radome-lens comprises a shell of dielectric material having an outer surface in the form of a small circle defined by a sphere and a plane intersecting the sphere, an opening at one end of the shell for reception of an antenna therein, the surface having a central axis which is normal to the plane and extends through the center of the sphere, and an inner surface having a spherical portion centered at a second center disposed along the axis adjacent the first mentioned center but spaced toward the outer surface. When so constructed, the invention functions as a radome in the sense that it houses and protects an antenna in the usual manner and also functions as a lens in the sense that it amplifies the scan angle of the antenna from an angle of less than 90° to 90° or more.

3 Claims, 3 Drawing Sheets

RADOME-LENS EHF ANTENNA DEVELOPMENT

This invention relates to a radome-lens.

BACKGROUND OF THE INVENTION

A radome is a thin shell of uniform thickness which is normally used to house and protect an antenna from the weather. Because of the interposition of the radome between the antenna and outside space from which the antenna is to receive or transmit signals, the radome always adds some refraction and insertion losses to the signal and, as a consequence, the radome has heretofore been regarded as hinderance to the radiation performance of the antenna.

A further problem with which the present invention is concerned relates to the number of antennas which are employed to cover the whole spherical sky, and, particularly, with minimizing the number of antennas required for this purpose. Assuming that each antenna is mounted on an altitude-azimuth mount or its equivalent, the scanning area of each antenna is a circular region. The term --circular region-- is referable to a --small circle-- which, in the terminology of spherical trigonometry, is the intersection of a sphere and a plane cutting the sphere.

The largest circular region is the spherical sky itself. It is not possible for a single antenna to scan the entire sky because of blockage by the antenna mount. The next largest region, then, is a hemispherical region. Two antennas, with their broadside directions pointing in opposite directions, are required to scan the entire sky, provided that each antenna is capable of scanning up to 90° from the broadside direction. However, if such antennas are not available, it can be shown that four antennas would be required to cover the entire sky without holes with their broadside directions being the normals of the surfaces of an equilateral tetrahedron. In that case, the scanning angle required from each antenna must range between 0° to 70.5°, which is not significantly reduced from the 90° required for a two antenna configuration. Thus, it is clearly highly desirable to provide a radome-lens comprising: a shell of dielectric material having an outer surface in the form of a small circle defined by a sphere and a plane intersecting said sphere, an opening at one end of the shell for reception of an antenna therein, the surface having a central axis which is normal to the plane and extends through the center of the sphere, and an inner surface having a spherical portion centered at a second center disposed along the axis between the first mentioned center and the outer surface and including a plurality of zones extending toward the opening and concentrically disposed along the axis, each zone being centered at the second center, adjacent zones being separated by a frusto-conical surface which converges at the second center, the radial height, h, of each frusto-conical surface being given by $$h = \frac{\lambda_o}{(\epsilon r)^{\frac{1}{2}} - 1}$$

wherein $\lambda_o$ is the designed wavelength of the incident or transmitted wave, and $\epsilon_r$ is the relative permittivity of the lens.

When so constructed, the present invention functions as a radome in the sense that it houses and protects an antenna in the usual manner. It also functions as a lens in the sense that it amplifies the scan angle of the antenna from an angle of less than 90°to 90° or more without much spherical aberration. Such amplification avoids ground lane obstruction and, accordingly, only two antennas, each equipped with the radome-lens of the present invention are required to cover the whole sky. In an aperture planar phased array with electronic scanning, such amplification enables the array to retain substantial antenna gain and partial dual polarization capability.

The aperture could be a microstrip antenna array scanned completely electronically or a reflector scanned completely mechanically, or other hybrid systems of microstrip antennas and reflectors with partial electronic and partial mechanical scanning.

Also in accordance with the invention there is provided a radome-lens for housing an antenna and amplifying transmitted or received rays, comprising: a shell of dielectric material, said shell having an outer surface, at least a portion of said outer surface being in the form of a small circle defined by a sphere and a plane intersecting said sphere, said outer surface defining a central axis normal to said plane and extending through the center of said sphere, an opening at one end of said shell for reception of an antenna therein, and an inner surface having a spherical cap portion at the end of said inner surface remote from said opening and a plurality of zones extending from said cap toward said opening, said cap and each said zone being concentrically disposed about said axis and centered at a second center, said second center lying on said central axis between said first mentioned center and said outer surface, and said zones being disposed between said second center and said cap, the radius of each said zone being larger by a predetermined amount than its adjacent zone remote from said opening, and said cap and each said zone being separated from its adjacent zones by a frusto-conical surface which converges at said second center, the radial height, h, of each said frusto-conical surface being given by:

$$h = \frac{\lambda_o}{(\epsilon r)^{\frac{1}{2}} - 1}$$

where $\lambda_o$ is the design wavelength of the incident or transmitted wave, and $\epsilon_r$ is the relative permittivity of the lens.

Further in accordance with the invention there is provided a radome-lens for housing an antenna and amplifying transmitted or received rays, comprising: a shell of dielectric material, said shell having an outer surface, at least a portion of said outer surface being in the form of a small circle defined by a sphere and a plane intersecting said sphere, said outer surface defining a central axis normal to said plane and extending through the center of said sphere, an opening at one end of said shell for reception of an antenna therein, and an inner surface having a spherical cap portion at the end of said inner surface remote from said opening and a plurality of zones extending from said cap toward said opening, said cap and each said zone being concentrically disposed about said axis and centered at a second center, said second center lying on said central axis between said first mentioned center and said outer surface, and said zones being disposed between said second center and said cap, the radius of each said zone being larger by a predetermined amount than its adjacent zone remote from said opening, and said cap and each said zone being separated from its adjacent zones by a frusto-conical surface which converges at said second center, said radome-lens being adapted for reception or transmission of frequencies $f_1$ and $f_2$ wherein $f_2$ is almost twice $f_1$, i.e., $$f_2=2f_1+\Delta f$$

and the radial height, h, of each said frusto-conical surface being given by:

$$h=\frac{3c}{f_1+f_2}\cdot\frac{1}{(\epsilon_r)^{\frac{1}{2}}-1}$$

wherein c=speed of light, $\epsilon_r$=the relative permittivity of said lens.

BRIEF DESCRIPTION OF THE DRAWINGS

These and other features of the invention will become more apparent from the following description in which reference is made to the appended drawings, wherein.

DETAILED DESCRIPTION OF A PREFERRED EMBODIMENT

Figure 1:
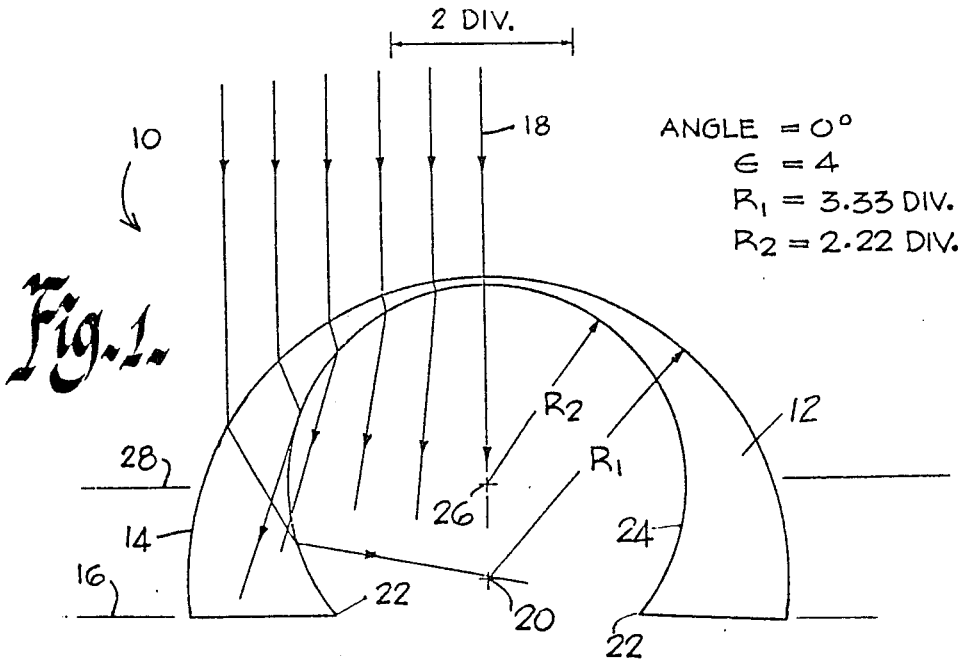
FIG. 1 is a cross sectional view of a fish-eye lens at a scan angle of 0°.
Figure 2:
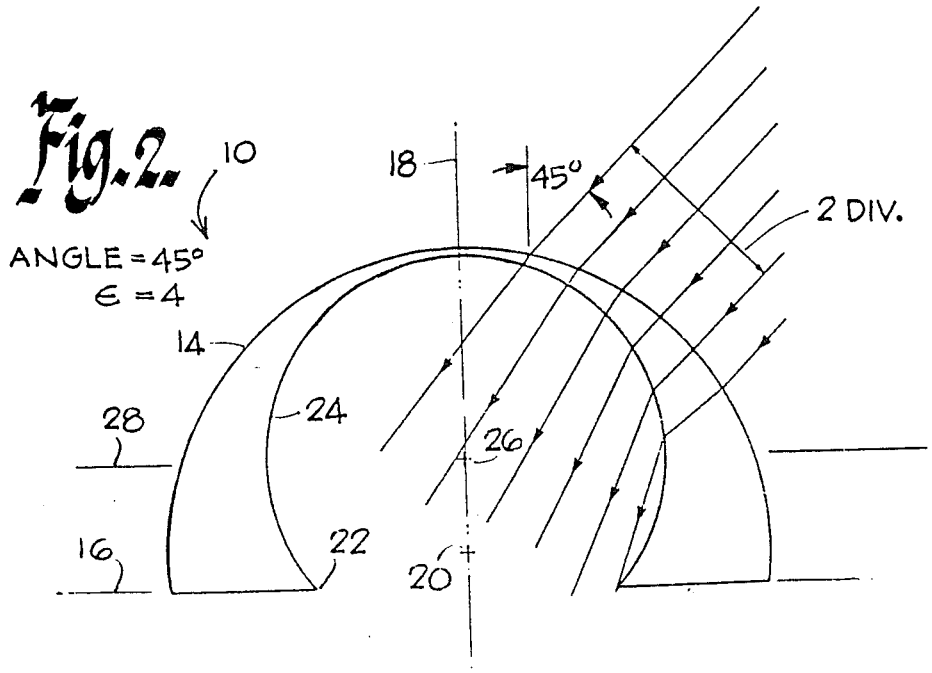
FIG. 2 is a cross sectional view of a fish-eye lens at a scan angle of 45°.
Figure 3:
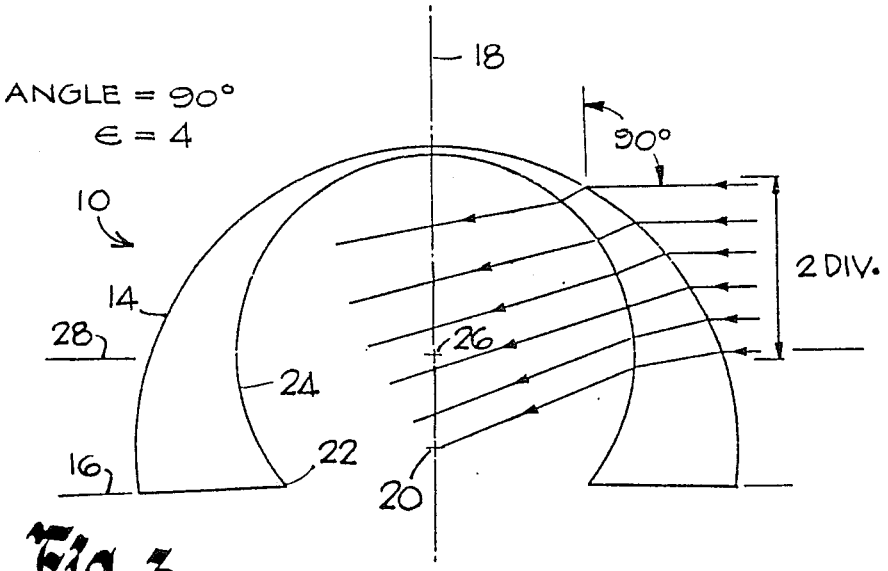
FIG. 3 is a cross sectional view of a fish-eye lens at a scan angle of 90°.

FIGS. 1 to 3 illustrate the present invention 10 in its simplest form. This embodiment will be referred to as a fisheye lens. The fish-eye lens is in the form of a shell 12 formed of dielectric material and includes an outer surface 14 in the form of a small circle defined by a sphere and a plane 16 intersecting the sphere. The outer surface defines a central or broadside axis 18 which is normal to plane 16 and extends through the center 20 of the sphere. An opening 22 is formed at one end of the shell for insertion of an antenna (not shown) into the shell. The aperture antenna is presumed to be capable of receiving parallel or substantially parallel rays by proper phasing or focussing. The shell further includes an inner spherical surface 24 centered at a second center 26 slightly spaced from center 20 along the broadside axis toward the outer surface as shown. Reference numeral 28 designates a ground plane.

If the aperture antenna is pointed at 0° from the broadside axis, as shown in FIG. 1, it receives parallel rays from outside the lens at a 0° scan angle. However, if the aperture antenna is pointed at 34° from the lens axis, as shown in FIG. 2, it receives parallel rays from outside the lens at a 45° scan angle. This means that there is an average bending of 11° and the scan angle of the receiving antenna is amplified from 34° inside the lens to 45° outside the lens. If the aperture antenna is pointed at 73° from the lens axis, as shown in FIG. 3, it receives parallel rays from outside the lens at a 90° scan angle. Thus, there is an average bending of 17° and the scan angle of the receiving antenna is amplified from 73° inside the lens 90° outside the lens. It will be seen therefore that the fish-eye lens functions as a negative lens in that it forms a wide angle lens for scanning angle amplification.

It will be seen that the fish-eye lens is effectively a radome for the aperture antenna inside it. Unlike the radome, however, it is capable of bending incident rays to a smaller scanning angle for the aperture antenna therein. As shown in FIG. 3, for a 90° scanning angle, the bending raises the locations of the parallel ray bundle with respect to the ground plane so that it rises above the blockage due to the ground plane. The antenna beam widens because of foreshortening of the planar array at large scanning angles. The widening is most severe at 90° scanning angles. As the lens bends the rays so that they arrive at the planar array at 73° instead of 90°, the beam widening is substantially reduced. When the scanning angle reaches 90° from broadside, a dual polarization phased array is reduced to one polarization. As the lens bends the rays, the 90° rays do not reach the phase array inside the lens at 90° but rather at about 73° and thus the dual polarization capability inside the lens is partially maintained.

Notwithstanding the aforementioned advantages of a fisheye lens, its base is necessarily very thick. Thick bases cause the lens to be excessively heavy, weighing about 100 Kg for antenna specifications discussed later, and to have very high insertion losses for rays passing through the thick base. The propagation loss in the dielectric of the lens could be 6 dB or more. These drawbacks can be corrected by zoning as explained below. In addition to reduction in weight and insertion losses, zoning substantially corrects the spherical aberration.

Figure 4:
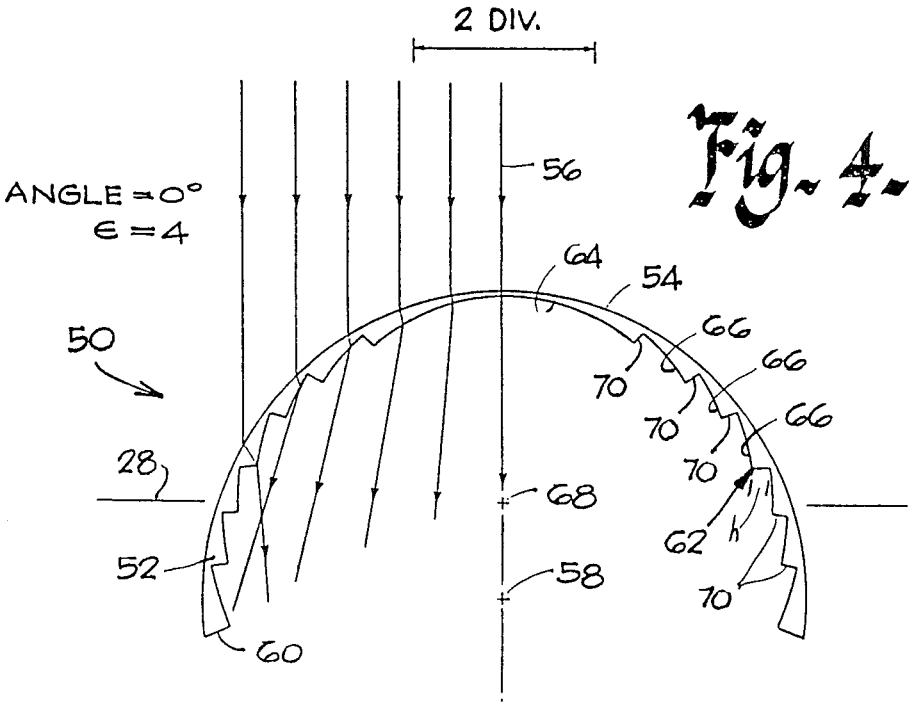
FIG. 4 is a cross sectional view of the radome-lens at a scan angle of 0°.
Figure 5:
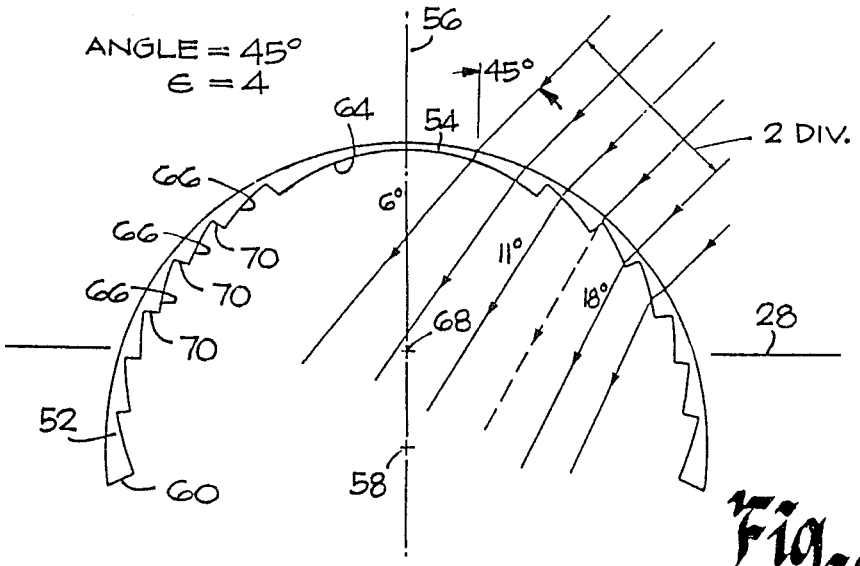
FIG. 5 is a cross sectional view of the radome-lens at a scan angle of 45°.
Figure 6:
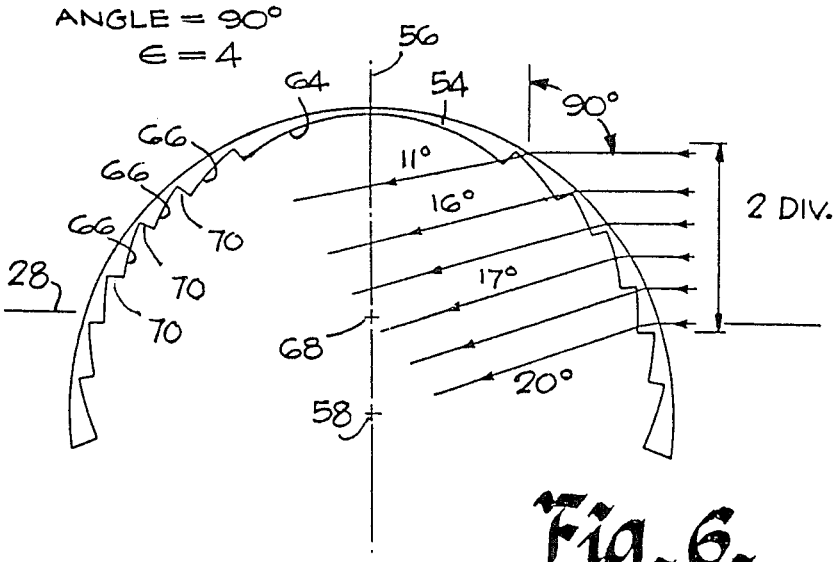
FIG. 6 is a cross sectional view of the radome-lens at a scan angle of 90°.

The radome-lens illustrated in FIGS. 4 to 6 is a zoned fish-eye lens. In the terminology of spherical trigonometry, a zone is the surface portion of a sphere included between two parallel planes cutting the sphere.

The radome-lens 50 is a shell 52 of dielectric material. At least a portion of the outer surface 54 of the shell is in the form of a small circle which defines a central or broadside axis 56 and is centered at 58. An opening 60 is formed at one end of the shell for insertion of an antenna into the shell.

The inner surface 62 of the shell is formed with a spherical cap portion 64 at the end of the inner surface remote from the opening and a plurality of zones 66 extending from the cap toward the opening. The cap and zones are concentrically disposed about axis 56 and centered at a second center 68 which lies on the central axis adjacent center 58 but spaced therefrom in the broadside direction. The zones are disposed between center 68 and cap 64, although further zones could be included toward the base end. As shown in FIGS. 4 to 6, the radius of the zones are larger by a predetermined amount than their adjacent zones remote from the opening. The cap and zone are separated from their adjacent zones by frusto-conical surfaces 70 which converge at center 68. The shell is constructed so that the ground plane is disposed between centers 58 and 68.

As long as the zoned surfaces are spherical surfaces centered at the same origin as the inner spherical surface of the of the fish-eye lens, the central ray still suffers no refraction. Further, as long as the steps between the zones are along a radial surface from the common origin of the zoned surfaces, the central ray suffers no shadowing effect from the steps. Other rays suffer a little refraction and shadowing but these are only second order effects.

As shown in FIG. 4, the central ray of the incident parallel rays passes through the origin of the inner spherical surface. This means that the central ray is perpendicular to the inner spherical surface and therefore is not refracted. FIGS. 5 and 6 illustrate the incident rays at angles of 45° and 90°, respectively. At these scan angles, the optical characteristics of the radome-lens are substantially the same as those of the fish-eye lens discussed earlier.

The step height, h, between the zones is that which would induce a wavelength path difference. More specifically.

$$h = \frac{\lambda_o}{(\epsilon_r)^{\frac{1}{2}} - 1} \quad (1)$$

where $\lambda_o$ is the desired wavelength of the incident ray and $\epsilon_r$ is the relative permittivity of the lens. At frequencies other than the central frequency, $f_o$, there will be a phase error in a step given by $$\Delta\phi = 2\pi\left(\frac{f}{f_o} - 1\right) \quad (2)$$

The phase error accumulates for successive zoning steps. Thus for N zones, the phase error is $$\Delta\phi = 2\pi N\left(\frac{f}{f_o} - 1\right) \quad (3)$$

The radome-lens can also be configured for two frequencies $f_1$ and $f_2$ wherein the $f_2$ is almost twice $f_1$, i.e., $$f_2 = 2f_1 + \Delta f \quad (4)$$

where $\Delta f$ is a small increment of frequency. If $f_o$ is the frequency that results in exactly one wavelength difference in a step height h, then, from (1), $$h = \frac{c}{f_o} \cdot \frac{1}{(\epsilon_r)^{\frac{1}{2}} - 1} \quad (5)$$

where c is the speed of light and $\epsilon_r$ is the relative permittivity of the lens.

If $f_1 \sim f_0$, the phase error of the step is:

$$\Delta\phi_1 = 2\pi\left(\frac{f_1}{f_o} - 1\right) \quad (6)$$

and the phase error in $f_2$ is $$\Delta\phi_2 = 2\pi\left(\frac{f_2}{f_o} - 1\right) \quad (7)$$

Whether $\Delta f$ is positive or negative, the phase errors in the two frequencies must be opposite to each other, i.e.:

$$-\Delta\phi_1 = \Delta\phi_2 \quad (8)$$

Substituting (6) and (7) into (8), and rearranging the terms:

$$f_o = (f_1 + f_2)/3 \quad (9)$$

Substituting (9) into (5), $$h = \frac{3c}{f_1 + f_2} \cdot \frac{1}{(\epsilon_r)^{\frac{1}{2}} - 1} \quad (10)$$

Based on (9) and (10) and in terms of $f_1$ only $$f_1 = \frac{3f_o - \Delta f}{3} \quad (11)$$

With (11) into (6), the phase error is $$\Delta\phi_1 = -2\pi(\Delta f/3f_o) \quad (12)$$

Substituting (9) into (12), the absolute value of the phase error per step is $$\Delta\phi = |\Delta\phi_1| = 2\pi(\Delta f/f_1 + f_2)) \quad (13)$$

Since the phase error accumulates of a sequence of step, then for N steps, $$\Delta\phi = \frac{\Delta f}{f_1 + f_2} \quad (14)$$

The radome-lens amplifies the scanning angle from more or less parallel rays within the lens enclosed area to the parallel rays without. As observed in FIGS. 4–6, such parallel rays within the radome-lens can be incident on any aperture antenna with the proper phasing or focussing. Therefore, the design of the radome-lens is basically independent of the antenna within it.

EXAMPLE

The requirements of the radome-lens may be as follows:

(a) The radome-lens must be large enough to accommodate an aperture antenna with about 40 dB gain at 43.6 GHz or 34 dB at 21.15 GHz for all scanning angles.

(b) The radome-lens must be able to accommodate rays down to 90° scanning angle without obstruction from the ground plane.

(c) the radome-lens must be light weight.

Using the aforementioned formulas, as shown hereinafter, the results are as follows:

(1) The radome-lens has the shape illustrated in FIGS. 4 to 6.

(2) The outer radius of the radome-lens is 22.85 cm.

(3) The number of steps of zoning is 5.

(4) The step height is 1.38 cm.

(5) The most severe phase error is (for the outer ray at 90° scan) is 36.1°.

(6) The dielectric volume of the radome-lens is 4921 $cm^3$.

(7) The weight of the radome-lens is 9.8 Kg, for a specific gravity of 2.

(8) The dielectric constant is 4.

(9) The most severe insertion loss due to reflection of surfaces is 4 dB and the average loss is 2 dB.

In order to satisfy requirement (a), the 40 dB gain means that the directivity, D, must be $10^4$. Since $$D = 4\pi A_\lambda = 4\pi(\pi R_\lambda^2) \quad (15)$$

where $A\lambda$ is the aperture area in wavelength square and $R\lambda^2$ is the radius in wavelength of the aperture antenna. Assuming the aperture antenna to be circular, then $$R_\lambda = (10{,}000/4\pi^2)^{\frac{1}{2}} = 15.92\lambda \sim 16\lambda \quad (16)$$

At $f_2=43.6$ GHz, the wavelength $\lambda 2=0.69$ cm, and $R_\lambda$ of the aperture is translated to $$R=15.92\lambda\times 0.69\ cm = 10.98\ cm \quad (17)$$

If R is taken as 1.6 division widths of parallel rays in FIG. 6 for scanning to 90°, the required radius $R_{outer}$ of the outer sphere of the radome-lens is about 3.33 divisions or $$R_{outer}=(3.33/1.6)\times 10.98\ cm=22.85\ cm \quad (18)$$

i.e., a diameter of 45.70 cm. It is to be noted a division width is taken to be arbitrary and, inasmuch as it is used as a ratio, it is not important.

STEPS OF ZONING AND STEP HEIGHT

By measuring the original fish-eye lens of FIG. 3, the thickest part of the lens that a 3.2 divisions wide parallel ray bundle passes is about 1.0 division. One division translates to $10\lambda 2$ at 43.6 GHz and into a thickness, T, of 6.9 cm.

Let $\epsilon_r=4$ for the lenses of FIGS. 3 and 6. Then, according to equation (9), the zoning step height is $$h = \frac{3 \times 3 \times 10^{10}}{(43.6 + 21.15) \times 10^3} = 1.39 \text{ cm} \quad (19)$$

The number of steps, N, between the zones is given by $$N=T/h=6.9/1.39=5 \quad (20)$$

This is the number of steps shown in FIGS. 4 to 6.

MOST SEVERE PHASE ERROR

The phase errors for both frequencies are equal except for a change of signs. The most severe phase error at the edge of the lens is, according to equation (13), $$\Delta\phi = \frac{(f_2 - 2f_1)}{(f_1 + f_2)} = 0.63 \text{ rads} = 36.1°. \quad (21)$$

It will be appreciated by those skilled in this art that such an error is not a major problem.

VOLUME OF THE RADOME-LENS

From the step size in equation (18), it is expected that the average thickness of the lens is about 1.5 cm. Therefore, the dielectric volume of the radome-lens is $$V = 2\pi R^2 \times 1.5 \text{ cm} = 4921 \text{ cm}^3$$

WEIGHT OF THE RADOME-LENS

If the specific gravity of the dielectric is 2, then the mass of the lens is $$M = 2 \times 4921 = 9842 \text{ gm} = 9.84 \text{ Kg} = 21.71 \text{ lbs.}$$

INSERTION LOSS

The insertion loss is assumed to be a result of reflection from the surface. Based on sample calculations, it is assumed that the insertion loss can not be worse than 4 dB, and more probably 2 dB.

The embodiments of the invention in which an exclusive property or privilege is claimed are defined as follows:

1. A radome-lens comprising:

a shell of dielectric material having an outer surface in the form of a small circle defined by a sphere and a plane intersecting said sphere, an opening at one end of said shell for reception of an antenna therein, said surface having a central axis which is normal to said plane and extends through the center of said sphere, and an inner surface having a spherical portion centered at a second center disposed along said axis between said first mentioned center and said outer surface and including a plurality of zones extending toward said opening and concentrically disposed along said axis, each said zone being centered at said second center, adjacent zones being separated by a frustoconical surface which converges at said second center, the radial height, h, of each said frusto-conical surface being given by $$h = \frac{\lambda_o}{(\epsilon_r)^{\frac{1}{2}} - 1} \quad (1)$$

wherein $\lambda_o$ is the designed wavelength of the incident or transmitted wave, and $\epsilon_r$ is the relative permittivity of the lens.

2. A radome-lens for housing an antenna and amplifying transmitted or received rays, comprising:

a shell of dielectric material, said shell having an outer surface, at least a portion of said outer surface being in the form of a small circle defined by a sphere and a plane intersecting said sphere, said outer surface defining a central axis normal to said plane and extending through the center of said sphere, an opening at one end of said shell for reception of an antenna therein, and an inner surface having a spherical cap portion at the end of said inner surface remote from said opening and a plurality of zones extending from said cap toward said opening, said cap and each said zone being concentrically disposed about said axis and centered at a second center, said second center lying on said central axis between said first mentioned center and said outer surface, and said zones being disposed between said second center and said cap, the radius of each said zone being larger by a predetermined amount than its adjacent zone remote from said opening, and said cap and each said zone being separated from its adjacent zones by a frusto-conical surface which converges at said second center, the radial height, h, of each said frusto-conical surface being given by:

$$h = \frac{\lambda_o}{(\epsilon_r)^{\frac{1}{2}} - 1} \quad (1)$$

wherein $\lambda_o$ is the design wavelength of the incident or transmitted wave, and $\epsilon_r$ is the relative permittivity of the lens.

3. A radome-lens for housing an antenna and amplifying transmitted or received rays, comprising:

a shell of dielectric material, said shell having an outer surface, at least a portion of said outer surface being in the form of a small circle defined by a sphere and a plane intersecting said sphere, said outer surface defining a central axis normal to said plane and extending through the center of said sphere, an opening at one end of said shell for reception of an antenna therein, and an inner surface having a spherical cap portion at the end of said inner surface remote from said opening and a plurality of zones extending from said cap toward said opening, said cap and each said zone being concentrically disposed about said axis and centered at a second center, said second center lying on said central axis between said first mentioned center and said outer surface, and said zones being disposed between said second center and said cap, the radius of each said zone being larger by a predetermined amount that its adjacent zone remote from said opening, and said cap and each said zone being separated from its adjacent zones by a frusto-conical surface which converges at said second center, said radome-lens being adapted for reception or transmission of frequencies $f_1$ and $f_2$ wherein $f_2$ is almost twice $f_1$, i.e., $$f_2 = 2f_1 + \Delta f \quad (4)$$

and the radial height, h, of each said frusto-conical surface being given by:

$$h = \frac{3c}{f_1 + f_2} \cdot \frac{1}{(\epsilon_r)^{\frac{1}{2}} - 1} \quad (10)$$

wherein c=speed of light, $\epsilon_r$=the relative permittivity of said lens.

* * * * *